US010971824B2

(12) United States Patent
Baumgartner et al.

(10) Patent No.: US 10,971,824 B2
(45) Date of Patent: Apr. 6, 2021

(54) ANTENNA ELEMENT

(71) Applicant: IMS Connector Systems GmbH, Loffingen (DE)

(72) Inventors: Roland Baumgartner, Bonndorf-Wellendingen (DE); Jan Hesselbarth, Stuttgart (DE); Zunnurain Ahmad, Stuttgart (DE)

(73) Assignee: IMS Connector Systems GmbH, Loffingen (DE)

( * ) Notice: Subject to any disclaimer, the term of this patent is extended or adjusted under 35 U.S.C. 154(b) by 115 days.

(21) Appl. No.: 16/337,275

(22) PCT Filed: Sep. 29, 2017

(86) PCT No.: PCT/EP2017/074865
§ 371 (c)(1),
(2) Date: Mar. 27, 2019

(87) PCT Pub. No.: WO2018/060476
PCT Pub. Date: Apr. 5, 2018

(65) Prior Publication Data

US 2020/0036104 A1 Jan. 30, 2020

(30) Foreign Application Priority Data

Sep. 30, 2016 (EP) ..... 16191928

(51) Int. Cl.
*H01Q 13/10* (2006.01)
*H01Q 21/00* (2006.01)
*H01Q 7/00* (2006.01)

(52) U.S. Cl.
CPC ..... *H01Q 21/0075* (2013.01); *H01Q 7/00* (2013.01)

(58) Field of Classification Search
CPC .. H01Q 1/22–1/24; H01Q 7/00; H01Q 21/00; H01Q 13/10–13/18; H01P 3/12
See application file for complete search history.

(56) References Cited

U.S. PATENT DOCUMENTS 4,590,478 A 5/1986 Powers et al.
6,271,799 B1 8/2001 Rief et al.
(Continued)

FOREIGN PATENT DOCUMENTS

JP H05273234 10/1993

OTHER PUBLICATIONS

Hallbjörner, "Circuit board integrated patch transition between microstrip and rectangular waveguide, optimised for producibility," IEE Proceedings: Microwaves, Antennas and Propagation, Aug. 7, 2006, IEE, Stevenage, Herts, GB, vol. 153, No. 4, pp. 330-334.
(Continued)

*Primary Examiner* — Hasan Z Islam
(74) *Attorney, Agent, or Firm* — Akerman LLP; Peter A. Chibotti

(57) ABSTRACT

The application provides an antenna element comprising a circuit board with a transmission line, the transmission line comprising at least a first conductor and a second conductor, a separate 3-dimensional, metallic or metallized ring-shaped structure mounted on a surface of the circuit board, a first galvanic contact between the first conductor and a first part of the separate 3-dimensional, metallic ring-shaped structure, and a second galvanic contact between the second conductor and a second part of the separate 3-dimensional, metallic ring-shaped structure, wherein at least one of the first galvanic contact and the second galvanic contact comprises at least two substantially L-shaped sections and an antenna array comprising several such antenna elements.

12 Claims, 7 Drawing Sheets

(56) References Cited

U.S. PATENT DOCUMENTS

| | | | | |
|---|---|---|---|---|
| 7,088,290 | B2 * | 8/2006 | Ohno | H01Q 1/1221 343/700 MS |
| 8,350,767 | B2 * | 1/2013 | Brigham | H01Q 21/0025 343/725 |
| 9,806,393 | B2 * | 10/2017 | Kildal | H01P 11/002 |
| 2003/0132885 | A1 | 7/2003 | Kuramoto et al. | |
| 2009/0322636 | A1 | 12/2009 | Brigham et al. | |
| 2012/0032750 | A1 | 2/2012 | Feil | |
| 2013/0099989 | A1 | 4/2013 | Kuramoto et al. | |
| 2013/0241788 | A1 | 9/2013 | Anderson et al. | |
| 2014/0285383 | A1 | 9/2014 | Fakharzadeh et al. | |

OTHER PUBLICATIONS

World Intellectual Property Organization, "International Search Report," issued in International Patent Application No. PCT/EP2017/074865, dated Nov. 29, 2017, document of 4 pages.

European Patent Office, "Extended European Search Report," issued in European Patent Application No. 16191928.7, dated Mar. 14, 2017, document of 10 pages.

* cited by examiner

Fig. 3
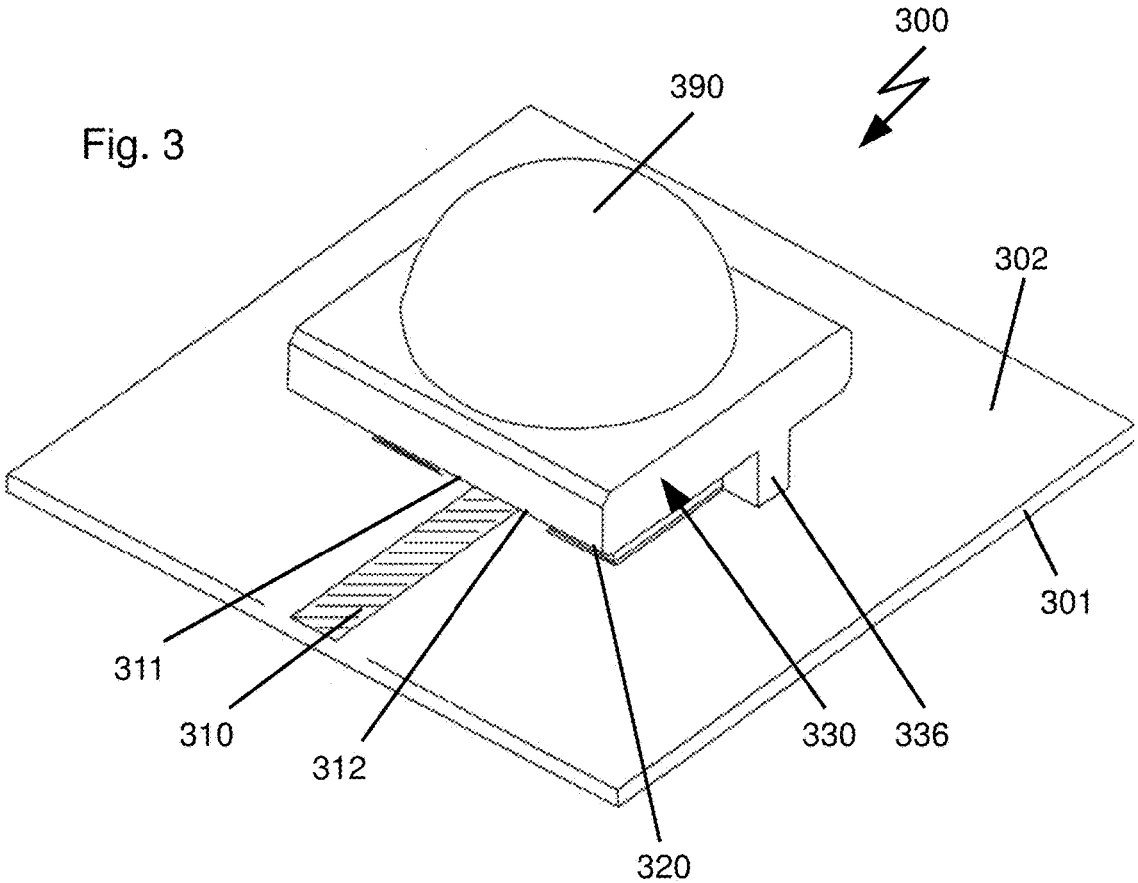
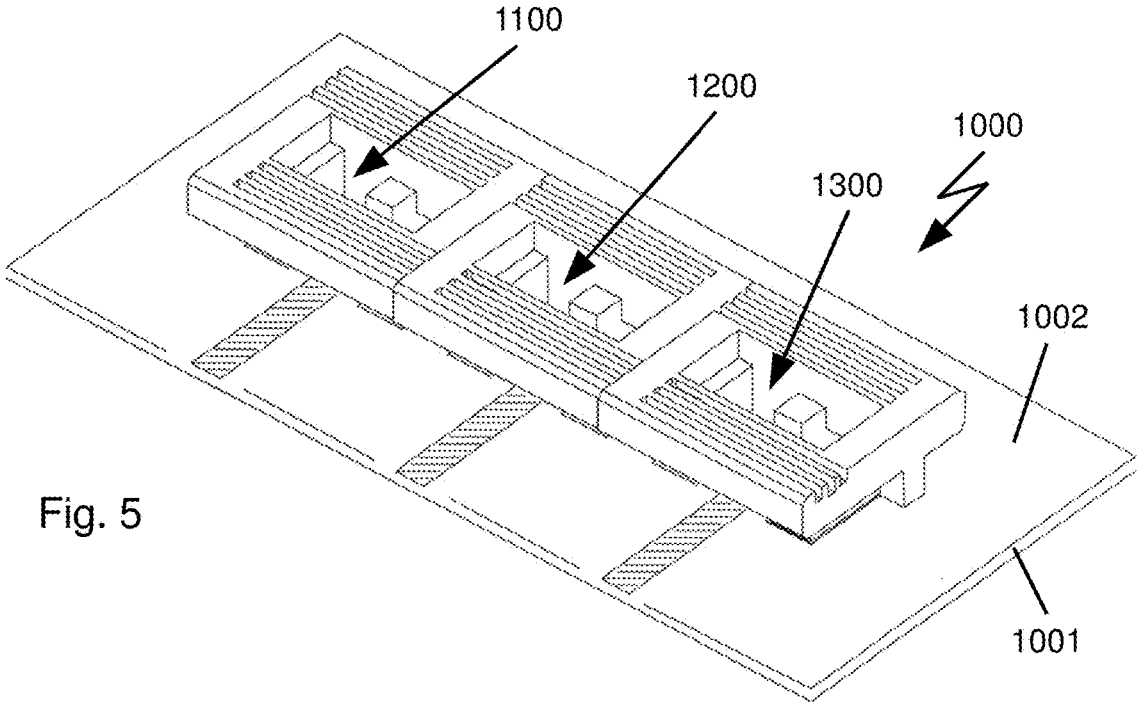
Fig. 5

ANTENNA ELEMENT

CROSS REFERENCE TO RELATED APPLICATIONS

This application is a § 371 National Phase of PCT/EP2017/074865, filed Sep. 29, 2017, the entirety of which is incorporated by reference and which claims priority to European Patent Application No. 16 191 928.7, filed Sep. 30, 2016.

FIELD OF INVENTION

The present application relates to antenna elements and to an array of antenna elements formed by an arrangement of antenna elements. More particularly, though not exclusively, it relates to antenna elements suitable for manufacture using surface mount soldering process techniques.

BACKGROUND

Wireless communication using radio waves as well as remote sensing using radio waves use electromagnetic waves of a dedicated frequency spectrum. For applications such as high data-rate communication or high-resolution remote sensing, electromagnetic waves of the so-called millimeter-wave frequency spectrum can be used advantageously. Whereas the term millimeter waves typically refers to frequencies in the range between 30 GHz and 300 GHz, in the context of this document the term is used for frequencies above 6 GHz, as it is sometimes done in the context of 5G, the fifth generation of mobile communication, in contrast to the classical mobile communication frequencies in the microwave range between 0.4 and 6 GHz.

Depending on assignments of regulatory bodies and technological constraints, frequencies in the so-called 60 GHz band, covering 57 GHz to 64 GHz approximately, are widely used for wireless communication with high data rate within the so-called "WiGig" standard (also known as "802.11ad" standard).

Other frequency bands and standards exist, and more are expected in the future.

Wireless communication systems, as well as many remote sensing systems, need both a transmitter and a receiver for electromagnetic waves. Both transmitter and receiver contain, at the interface between electronic circuitry and free space, an antenna in order to convert propagating electromagnetic waves from free space into guided waves—or voltages and currents—in the electronic circuitry, and vice versa. Thus, an antenna is characterized by an interface towards free space and an interface for a transmission line.

The antenna as a passive converter between the propagating electromagnetic waves from free space and the guided wave is electrically characterized by its dissipative properties (as in any passive device, some electromagnetic energy is converted to heat by conductive loss and dielectric loss) and by its behavior in the electric network. The dissipative properties are described by the term efficiency, relating the power lost to heat to the power passing through the antenna. Its frequency-dependent complex impedance describes the behavior of the antenna in the electric network best. Often relating this impedance to a typical feed transmission line characteristic impedance (of, for example, 50 Ohms), a voltage wave reflection coefficient can be defined. A small reflection coefficient means most power passes through the antenna. Thus, in a practical application, at all frequencies of operation the antenna needs to offer a small reflection coefficient to the feed power. This defines the antenna impedance bandwidth.

Other requirements for the antenna can be defined and depend on the respective application. For example, mobile user equipment for wireless communication needs antennas which are physically small, compact and of low weight. These antennas need to integrate smoothly into the wireless device. The antenna frequency bandwidth must match the application and efficiency must be high. As always, the possibility of cost effective manufacture and efficient system integration is required.

In previously disclosed literature, several circuit-board integrated antennas were proposed. Specifically, a stacked patch antenna was proposed in S. Brebels, K. Khalaf, G. Mangraviti, K. Vaesen, M. Libois, B. Parvais, V. Vidojkovic, V. Szortyka, A. Bourdoux, P. Wambacq, C. Soens, W. van Thillo, in "60-GHz CMOS TX/RX Chipset on Organic Packages with Integrated Phased-Array Antennas," European Conference on Antennas and Propagation (EuCAP), Davos, Switzerland, April 2016; a mesh-grid patch antenna was proposed in W. Hong, K. Baek, Y. G. Kim, Y. Lee, B. Kim, "mm Wave Phased-Array with Hemispheric Coverage for 5th Generation Cellular Handsets," European Conference on Antennas and Propagation (EuCAP), The Hague, Netherlands, April 2014; and variants of a Yagi-Uda antenna were proposed in W. Hong, S.-T. Ko, Y. Lee, K.-H. Baek, "Compact 28 GHz Antenna Array with Full Polarization Flexibility under Yaw, Pitch, Roll Motions," European Conference on Antennas and Propagation (EuCAP), Lisbon, Portugal, April 2015.

All these antennas suffer from low efficiency (typically, roughly 50% of power passing through the antenna is converted to heat) and high cost (relatively thick circuit board material needed for the stacked patch is expensive as it is based on PTFE-based plastic, multi-layer circuit boards are expensive to manufacture, sophisticated metallic connections through the circuit board are expensive to manufacture).

The present disclosure provides an antenna element combining characteristics such as large frequency bandwidth, high efficiency, compactness, ease of integration with conventional electronic circuit and packaging technologies, and possibly low cost, for applications at millimeter-wave frequency.

SUMMARY

The antenna element according to the present disclosure comprises a circuit board with a transmission line, the transmission line comprising at least a first conductor and a second conductor. In one embodiment, the transmission line can be a planar transmission line on the circuit board, comprising a metallic signal trace and a metallic ground trace and can connect the antenna to electronic circuitry of the transmitter or the receiver. The planar transmission line can be of well-known type, such as micro-strip line or co-planar waveguide. The characteristic impedance of the planar transmission line can be, for example, 50 Ohm.

The antenna element according to the present disclosure further comprises a separate, 3-dimensional, (in contrast to patch antennas, where additional structures are integral parts of a circuit board and considered to be essentially two-dimensional) metallic or metallized ring-shaped structure mounted on a surface of the circuit board. The cross-section of the metallic ring-shaped structure, seen parallel to the circuit board, is designed such that the electromagnetic wave of the given frequency for which the antenna element is designed can pass through it. It is possible to think of such a structure as a metal waveguide. An air-filled metal waveguide is characterized by a cutoff frequency below which wave propagation through a structure of such a cross-section is inhibited.

It should be noted that in the context of the present disclosure a structure is considered to be ring-shaped if the electromagnetic wave in the air-filled region is, considering the cross-section of the structure, encircled/surrounded by a metal conductor of any cylindrical shape, the latter comprising for instance (but not limited to) square, rectangular, circular or elliptical shape (i.e. inner and/or outer cross-section) with or without one or several protrusions called ridges.

The antenna element of the present disclosure further comprises a first galvanic contact (i.e. a direct, galvanic, metal-to-metal contact, which shows lower series impedance and thus less signal disturbance and less tolerance sensitivity than the otherwise common coupling methods like series capacitance coupling or shunt inductance coupling and which preferably is formed by a planar surface area of each of the structures joined by the contact with the space (thin layer) between the planar surface areas being filled with electrically conductive material, e. g. solder or electrically conductive adhesive) between the first conductor and a first part of the separate 3-dimensional, metallic ring-shaped structure, and a second galvanic contact between the second conductor and a second part of the separate 3-dimensional, metallic ring-shaped structure, wherein at least one of the first galvanic contact and the second galvanic contact comprises at least two essentially L-shaped sections.

Preferably, in this configuration the two galvanic contacts are connected via the ring-shaped structure but otherwise RF-decoupled from each other, i.e. galvanically separated or connected only by RF-decoupling structures like a short with a length of $n*\lambda/4$, where n is an odd integer.

Specifically, if the at least two essentially L-shaped sections of the first or second galvanic contact lie in the same plane as the other galvanic contact, such an arrangement can be realized in a single-layer technology, especially if the first or second galvanic contact is electrically connected to a ground plane located on the rear side of the substrate, i.e. the side opposite to the side on which the separate, 3-dimensional, metallic ring-shaped structure is located, by vias which run through the substrate or if the first or second galvanic contact is electrically connected to at least one ground trace located in the same plane as the respective other galvanic contact.

In this way, it can be achieved that conductors (first conductor, second conductor) apart from a ground plane of the circuit board and vertical connections (vias) lie in a single plane.

According to the terminology used in this description, a contact comprises an essentially L-shaped section if it extends over an angular section of the above-described ring-shaped structure which comprises at least 20° and less than 170° of the 360° angular extension of the ring-shaped structure.

More specifically, there can optionally/preferably be a region in which the first part of the L and the second part of the L merge orthogonally. Accordingly, such an L-shaped section can e.g. be formed by a section of a circle and its radius.

It should be noted that these L-shaped sections do not have to be separated from each other, but may be connected to each other. Specifically, there are shapes resembling the letters U or C that can be formed using two or more L-shaped sections (and eventually further sections). Likewise, it should be noted that a T-shaped section comprises an L-shaped section as defined above.

The contact sections between the transmission line(s) and the ring-shaped part need to realize/provide a smooth transition for the guidance of the electromagnetic wave and the conduction of currents and also need to prevent leakage of the electromagnetic wave, which would result in radiation in unwanted directions, in unwanted couplings and power loss. The L-shape as described above with its angular extension allows for such a smooth transition.

As a result of the above-described air-filled ring-shaped structure contacted by the galvanic contacts to the at least two conductors of the at least one transmission line in the described/claimed way, the electromagnetic wave travelling along the transmission line to the antenna element will essentially (that is, with the prevailing part of its energy) be carried in the ring-shaped structure, to finally reach the aperture and radiate. The opposite direction of energy flow will be possible in a similar manner, as the antenna is a reciprocal device.

It turns out that in such a design even though the overall size of the antenna is small (that is, not much larger than one wavelength), the transition from a planar transmission line to the ring-shaped structure can be made such that the reflection coefficient at the feeding line is very small over a wide frequency band.

In a preferred embodiment, this effect can be enhanced if at least in the area that is covered and/or surrounded by the separate metallic or metallized ring structure the side of the circuit board opposite to the side on which the separate metallic or metallized ring structure is mounted is covered by a metallic ground plane, which may be contacted to the galvanic contact between ground line conductor and separate metallic or metallized ring structure through the circuit board.

According to a preferred embodiment of the present disclosure, the antenna element is designed for a wavelength $\lambda$ and the height of the separate, metallic or metallized ring-shaped structure is $>\lambda/3$. At a short distance above the circuit board, the metallic or metallized ring shaped structure ends, thereby forming a radiating aperture. The shape of the aperture and the form of the ring-shaped structure allow influencing, to some extent, the direction of radiation, described by the radiation pattern. If the overall height of the ring-shaped structure above the circuit board is rather small (less than—approximately—half of a wavelength at frequency of operation), then the maximum of radiation intensity will be directed perpendicular—or close to perpendicular—with respect to the circuit board and the size of the solid angle comprising rather strong radiation (called beamwidth) will be large. If the overall height is larger, other radiation patterns can be engineered.

According to a preferred embodiment of the present disclosure, the first galvanic contact and the second galvanic contact are arranged on (i.e. are formed in such a way that the formed galvanic contacts contact at least) opposite sides of the separate 3-dimensional, metallic or metallized ring-shaped structure.

Preferably, the first or the second galvanic contact contacts one side of the ring-shaped structure to the signal trace of the transmission line, and the second or the first galvanic contact contacts the opposite side of the ring-shaped structure to the ground trace of the transmission line.

It has been found that the performance of the antenna element benefits if the coupling between transmission line and the ring-shaped structure occurs via a galvanic contact between these components.

Specifically, this can be implemented in such a way that at least the conductors forming a signal trace (which—by their nature—interact with electromagnetic fields) joined with the ring-shaped structure by the respective galvanic contacts point away from the ring-shaped structure.

Structurally, this means that the signal trace(s) of the feed line(s) should preferably neither cross nor extend into the volume formed by the inner space of the ring-shaped structure plus its perpendicular projection to the side of the circuit board opposite to the side on which the separate metallic or metallized ring structure is mounted or, if design considerations do not permit this, it should cross or reach into said volume preferably as far away from the surface of the circuit board on which the ring-shaped structure is located as possible—e.g. on the opposite surface of the circuit board—, but at least more than ⅓ of the height of the circuit board below said surface.

One possibility to realize this involves leading the signal trace of said transmission line directly, specifically without crossing said volume, to the respective galvanic contact, but not beyond, and leading the ground trace on a metallized rear side of the circuit board (specifically using said metallized rear side as ground trace).

The metallic or metallized ring-shaped structure can include mechanical features supporting a cost-efficient assembly technology, such as mounting pins, bevel edges for improved solder flow, flat area for pick-and-place, openings for visual inspection. The metallic or metallized ring-shaped structure can also include mechanical features for achieving the required impedance bandwidth and the required radiation pattern, such as impedance steps and features to affect diffraction of fields (bevel edges, narrow slits, and corrugated surfaces).

A particularly suitable technology for cost-efficient manufacture of such rather complex ring-shaped parts is injection molding. The use of plastic injection molding with subsequent metallic plating of the molded parts, followed by surface-mount soldering them on circuit boards, is well established and very cost-efficient while maintaining a high degree of accuracy, leading to metallized structures. Metallic structures can be created by application of MIM (metal injection moulding) or PIM (powder injection moulding) techniques.

The ring-shaped structure forming the actual antenna element of the present disclosure can be molded and removed from the mold as a single part, that is, it does not have any indentations, which makes the manufacture particularly efficient.

Specifically, according to a preferred embodiment of the present disclosure the separate 3-dimensional, metallic or metallized ring-shaped structure is shaped in such a way that it bridges a gap between the first conductor and the second conductor.

In this way, creation of an electrical short can be avoided in spite of providing a closed ring shaped structure.

In order to create the possibility to perform quality control in a convenient and easy way, the separate 3-dimensional, metallic or metallized ring-shaped structure can be shaped in such a way that it comprises an opening for optical inspection of one of said galvanic contacts.

According to another preferred embodiment of the present disclosure, the separate 3-dimensional, metallic or metallized ring-shaped structure comprises at least one ridge or a pair of ridges with equal or different protrusion depth that are located opposite to each other on opposing sides of the separate 3-dimensional, metallic or metallized ring-shaped structure. The cutoff frequency of a waveguide cross-section can be reduced by this optional introduction of one or two ridges.

This embodiment can be refined further if the separate 3-dimensional, metallic or metallized ring-shaped structure comprises two pairs of ridges or single ridges wherein said pairs of ridges or single ridges are oriented orthogonally to each other in a plane parallel to the circuit board.

In a preferred embodiment, the antenna comprises two transmission lines and the respective galvanic contacts between transmission line and metallic or metallized ring-shaped structure are located on terminal sections of the respective conductors forming the signal traces, at which the terminal sections of the conductors preferably run orthogonally to each other in the plane of the circuit board. In this way, a dual polarized antenna element can be created in an easy and convenient way.

In order to facilitate easy and precise mounting of the separate 3-dimensional, metallic or metallized ring-shaped structure on the circuit board, the separate 3-dimensional, metallic or metallized ring-shaped structure preferably comprises or is preferably connected to pins. If said ring shaped structure has been formed by injection moulding techniques, injection points of the injection moulding are preferably located on said pins.

According to another preferred embodiment of the present disclosure, at least sections of the sidewalls of the separate 3-dimensional, metallic or metallized ring-shaped structure that define an opening of the separate 3-dimensional, metallic or metallized ring-shaped structure are tapered or stepped in order to improve the radiation process.

Also, it has turned out to be advantageous for the removal of unwanted sidelobes in the radiation pattern, if at least some sections of sidewalls of said separate 3-dimensional, metallic or metallized ring-shaped structure that define a radiating aperture of the antenna element have a higher thickness than the remaining parts of the separate 3-dimensional, metallic or metallized ring-shaped structure.

Another optional but advantageous possibility to achieve a reduction of unwanted sidelobes in the radiation pattern is to provide at least some sections of sidewalls of said separate 3-dimensional, metallic or metallized ring-shaped structure that define the radiating aperture of the antenna element with a corrugated surface.

If at least one suction area is provided on a surface of said separate 3-dimensional, metallic or metallized ring-shaped structure, suction-based pick and place techniques can be applied for placing and mounting of the antenna element.

According to another preferred embodiment of the present disclosure, a dielectric focusing element is located on top of the radiating aperture of the antenna element. This dielectric focusing element can, e.g., be a sphere, a cone, a rod, or a horn made of a dielectric material. Also, in order to increase focusing (or directivity) of the radiation of the antenna structure, or to reduce coupling to additional, close by antenna elements, a small dielectric lens element can be added to the top opening of the metallic ring-shaped structure.

Advantageously, the transmission line is a microstrip planar transmission line or a co-planar waveguide planar transmission line.

Several of the antenna structures according to the present disclosure can be placed close to each other on the same circuit board, thereby forming an antenna array. Antenna arrays are suitable in wireless communications to create beam forming and beam steering functionality or support so-called MIMO transmission schemes. The antenna structures can be placed with all their axes parallel to each other, or alternatively, with their axes in different directions. In the latter case, polarization-versatile or dual-polarized antenna arrays can be designed.

A prototype antenna operating in the 60 GHz band shows a measured impedance bandwidth (defined as reflection coefficient smaller than −10 dB) of 14% (55.5 GHz to 64 GHz) and a simulated radiation efficiency of more than 96% (57 GHz to 64 GHz), underlining the advantageous characteristics of the proposed antenna elements.

BRIEF DESCRIPTION OF DRAWINGS

Next, the present application is explained in more detail using figures showing specific embodiments of the disclosure. The figures show:

FIG. 3: a third embodiment of an antenna element,

FIG. 5: a first embodiment of an antenna array.

DETAILED DESCRIPTION

Figure 1:
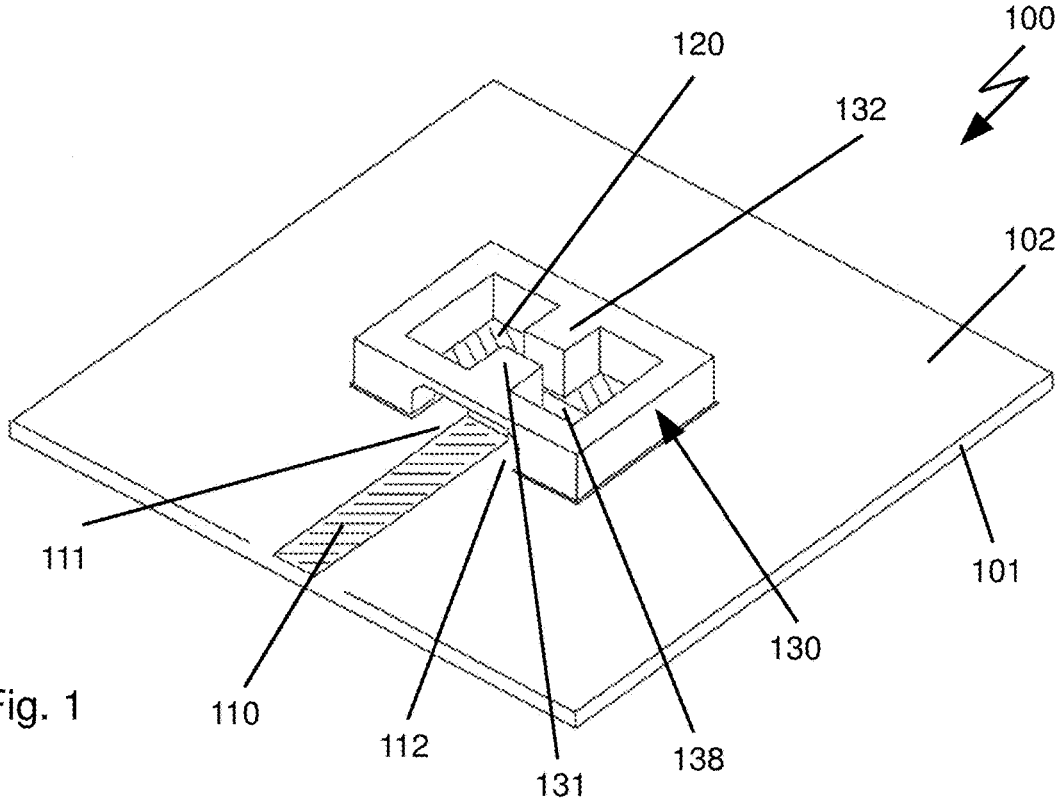
FIG. 1: a first embodiment of an antenna element.

FIG. 1 shows a first embodiment of an antenna element 100. The antenna element 100 comprises a circuit board 101 with a transmission line comprising a first conductor 110 and a second conductor 120 located on the surface 102 of circuit board 101. In this example, the visible part of the second conductor 120 extends through the circuit board 101 to the rear side of the circuit board 101 which is not visible in FIG. 1 and continues on said rear side of the circuit board 101 or merges with a metallized plane on said rear side.

On top of the circuit board a separate, 3-dimensional, metallic or metallized ring-shaped structure 130 is located on surface 102 of the circuit board 101. The ring-structure 130 has an essentially rectangular shape, but bridges gaps 111, 112 that are provided between the first conductor 110 and the second conductor 120. Furthermore, the ring-shaped structure 130 has two ridges 131, 132 each extending from the center of one of the long sides of the rectangular shape of the ring-shaped structure 130 towards the respective opposite long side. The cutoff frequency of a waveguide cross-section can be reduced by this optional introduction of one or two metallic ridges, creating a dual-ridge cross-section.

A first RF contact, which cannot be seen in the representation of FIG. 1, is formed between an end region of the first conductor 110 and the lower face of ridge 131, e.g. by soldering as a first galvanic contact.

A second RF contact, which also cannot be seen in the representation of FIG. 1, is formed in the same way between parts of the section of the second conductor 120 and the lower face of the ring-shaped structure 130 located above it. It should be noted that this second galvanic contact comprises a total of four L-shaped sections, one at each corner of the essentially rectangular ring-shaped structure 130.

Figure 2A:
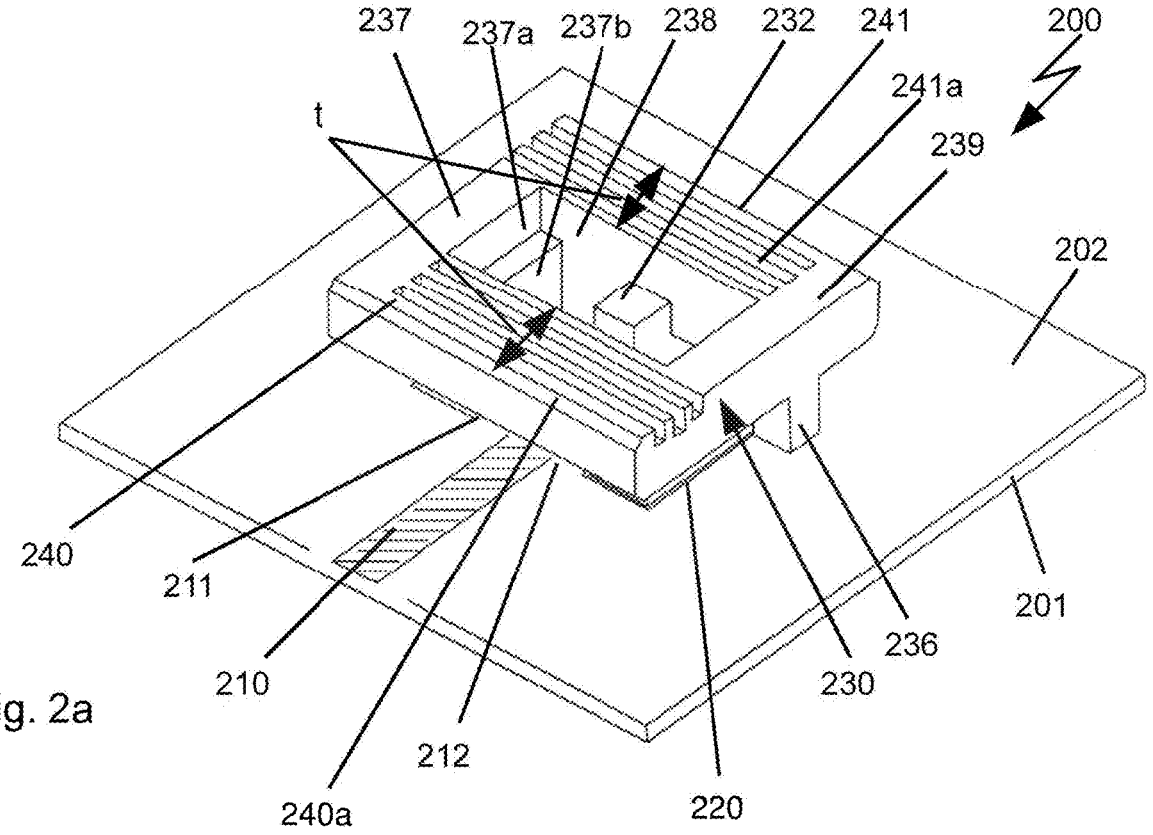
FIG. 2*a*: a second embodiment on an antenna element.
Figure 2B:
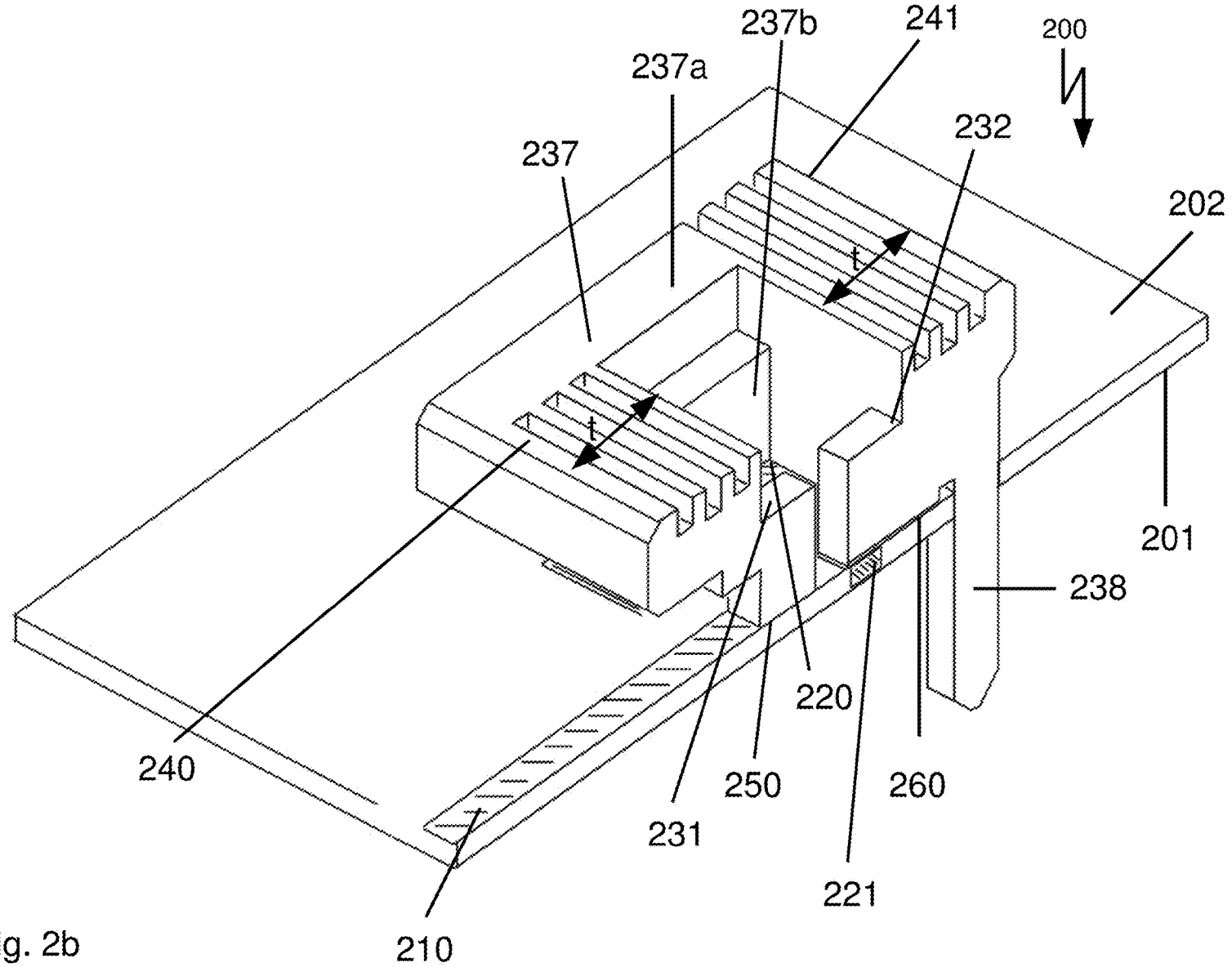
FIG. 2*b*: a cross section of the antenna element of FIG. 2*a*.

The embodiment of the antenna element 200 shown in FIG. 2*a* and FIG. 2*b* with circuit board 201 with surface 202, transmission line comprising a first conductor 210 and a second conductor 220, separate, 3-dimensional, metallic or metallized ring-shaped structure 230 is located that has an essentially rectangular geometry and bridges gaps 211, 212 between the first conductor 210 and the second conductor 220 and ridges 231, 232 is different in that its ring-shaped structure 230 is more complex and has additional features described in more detail below compared to the ring-shaped structure 130 of the embodiment according to FIG. 1.

It should be stressed, however, that the galvanic contacts 250, 260 between the ring-shaped structure 230, first conductor 210 and second conductor 220 are formed in the same way as described above for ring-shaped structure 130, first conductor 110 and second conductor 120 of the embodiment of FIG. 1. Some more details about these RF connections are explained now with reference to FIG. 2*b*.

FIG. 2*b* shows a cross section through the antenna element 240 as obtained by cutting along a plane that is oriented orthogonal to the surface 202 of the circuit board 201 and parallel to the side 237 of the ring-shaped, metallic or metallized structure 230. As can be seen from FIG. 2*b*, the first galvanic contact 250 is formed between the bottom surface of ridge 231 and the end region of the first conductor 210 that is covered by this bottom surface, e.g. in this example preferably by soldering said bottom surface to the first conductor 210. It should be remembered, however, that in general galvanic contacts can be formed even if no direct galvanic contact is present.

The second galvanic contact 260 is also formed between the surface of the second conductor 220 that is located on the side of the surface 202 of the circuit board 201 and a part of the bottom surface of the ring-shaped structure 230. As can be seen from FIG. 2*b*, this surface of the second conductor is connected through the circuit board 201 by connecting section 221 to the rear side of the circuit board, e.g. to a metallized backplane.

The part of the surface of the second conductor 220 that is part of FIG. 2*b* is located on the side of the surface 202 of the circuit board 201 has a first section that is located under and arranged parallel to the side 237 of the ring-shaped structure 230, but is broader than said side 237 and therefore partly visible, a second section that is located under and arranged parallel to the side 241 and a third section that is located under and arranged parallel to the ridge 232.

It should be noted that the cutting plane that leads to the representation of FIG. 2*b* forms a mirror plane with respect to the first and second conductor, so that the total shape of the surface of the second conductor 220 that is located on the side of the surface 202 of the circuit board 201 can essentially be described as an inverted U-shape with a protrusion on the symmetry axis of the U extending into the inner space of the U.

Analyzing the part of the contact region between the ring-shaped structure 230 and the second conductor 220, which forms the section of the second galvanic contact 260 that is shown in FIG. 2*b*, e.g. by soldering of the respective surfaces facing each other, one notices that the this section of the second galvanic contact 260 comprises three L-shaped sections:

The first L-shaped section is located between the bottom corner of sides 240 and 237 of the ring-shaped structure 230 and one of the parallel sides of the U with protrusion formed by said surface of the second conductor 220 (because this side of the U is broader than the side 237 of the ring-shaped structure 230).

The second L-shaped section is located between the bottom corner of sides 237 and 241 of the ring-shaped structure 230 and the same parallel side of the U with protrusion formed by said surface of the second conductor 220 (again because this side of the U is broader than the side 237 of the ring-shaped structure 230).

The third L-shaped section is located between the bottom corner of side 241 and protrusion 323 of the ring-shaped structure 230 and the connecting side of the U and the protrusion extending therefrom of said surface of the second conductor 220.

Returning now to FIG. 2*a*, in fact, the ring-shaped structure 230 comprises the ring-shaped structure 130, as the only difference between the lower part of the ring-shaped structure 230 that is located adjacent to the circuit board and the ring-shaped structure 130 of FIG. 1 is the presence of pins 236, 238 and an additional pin that is not visible in the representation of FIG. 2*a* and FIG. 2*b*. As can be recognized for pin 238 in FIG. 2*b*, these pins 236,238 are in this example inserted into corresponding holes in the circuit board 201 in order to facilitate exact positioning and better fixing of the ring-shaped structure 230 on the circuit board 201.

However, the ring-shaped structure 230 additionally comprises a section that extends to a greater height relative to the surface 202 of the circuit board 201 than the ring-shaped structure 130 relative to the surface 102 of the circuit board 101. In this section, several features are integrated into the ring-shaped structure in order to optimize its performance as an antenna and tailor its radiation characteristics.

First of all, the position of section 237*a* of the sidewall 237, and the corresponding part of the sidewall 239, which is not visible in FIG. 2, are shifted relative to the corresponding section 237*b* of sidewall 237 and the corresponding part of sidewall 239 that belong to the lower part of the ring-shaped structure 230 that resembles the ring-shaped structure 130 of FIG. 1 in such a way that the distance between the sidewalls 237 and 239 is increased in this direction and sections 237*a* and 237*b* as well as the corresponding sections of sidewall 239 form a stepped sidewall.

Next, it should be noted that the upper sections of the sidewalls 240, 241 have a higher thickness t than the remaining parts of the ring-shaped structure 230.

Last not least, there are sections 240*a*, 241*a* of the ring-shaped structure that define the radiating aperture 280 of the antenna element 200 that have a corrugated surface.

The main difference between the antenna element 200 of FIG. 2*a,b* and the antenna element 300 of FIG. 3 with circuit board 301 with surface 302, transmission line comprising a first conductor 310 and a second conductor 320, and separate, 3-dimensional, metallic or metallized ring-shaped structure 330 that has an essentially rectangular geometry and bridges gaps 311, 312 between the first conductor 310 and the second conductor 320 is that on top of its ring-shaped structure 330 a focusing element 390 is provided. This focusing element 390 can have, as shown, a semi-spherical shape. However, other shapes are possible, e.g. a conical shape or a rod-shaped structure or something similar like this. The galvanic contacts with L-shaped sections are formed in the same way as in the embodiments of FIG. 1 and FIG. 2*a,b*.

Figure 4A:
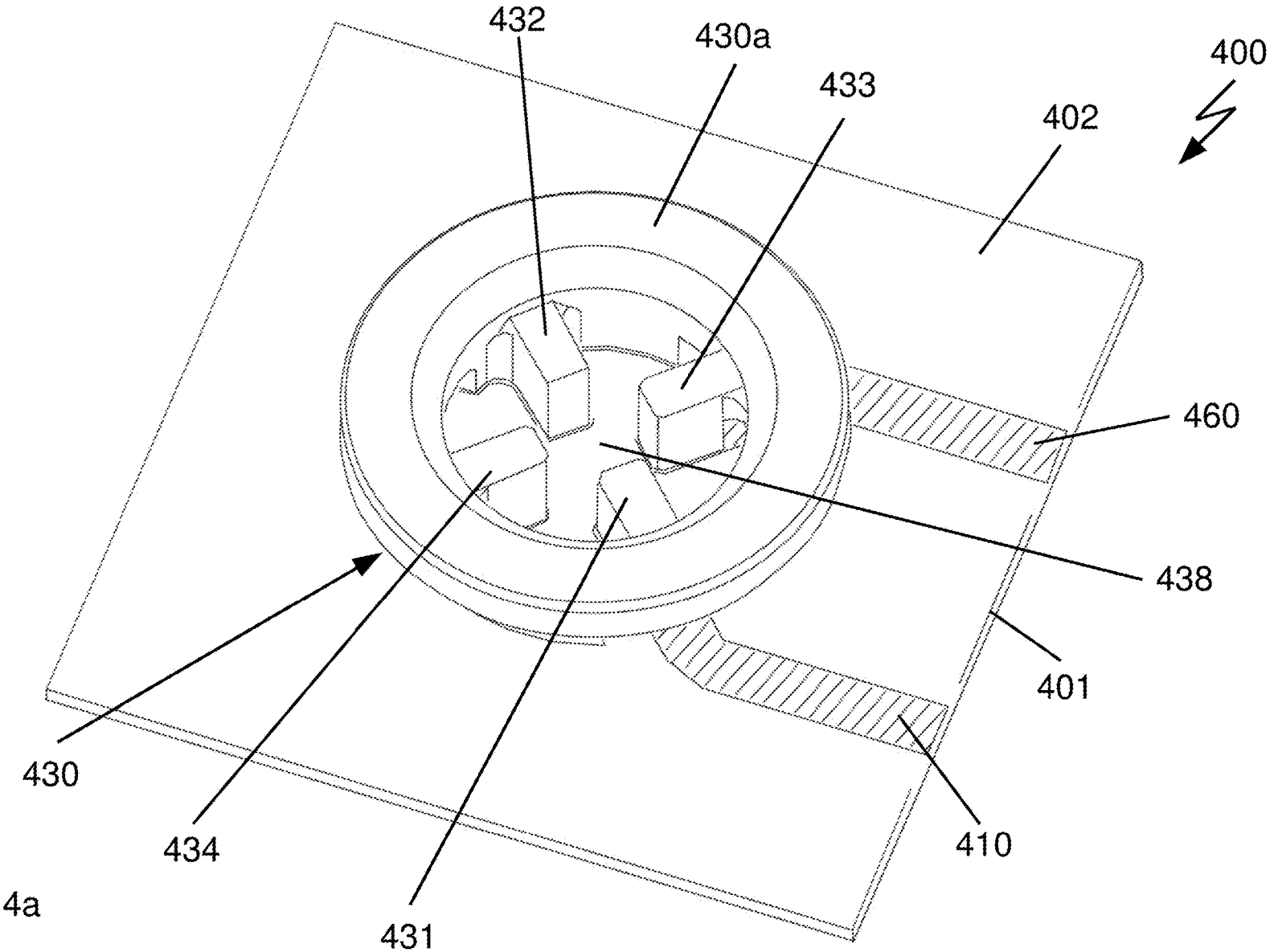
FIG. 4*a*: a fourth embodiment of an antenna element.
Figure 4B:
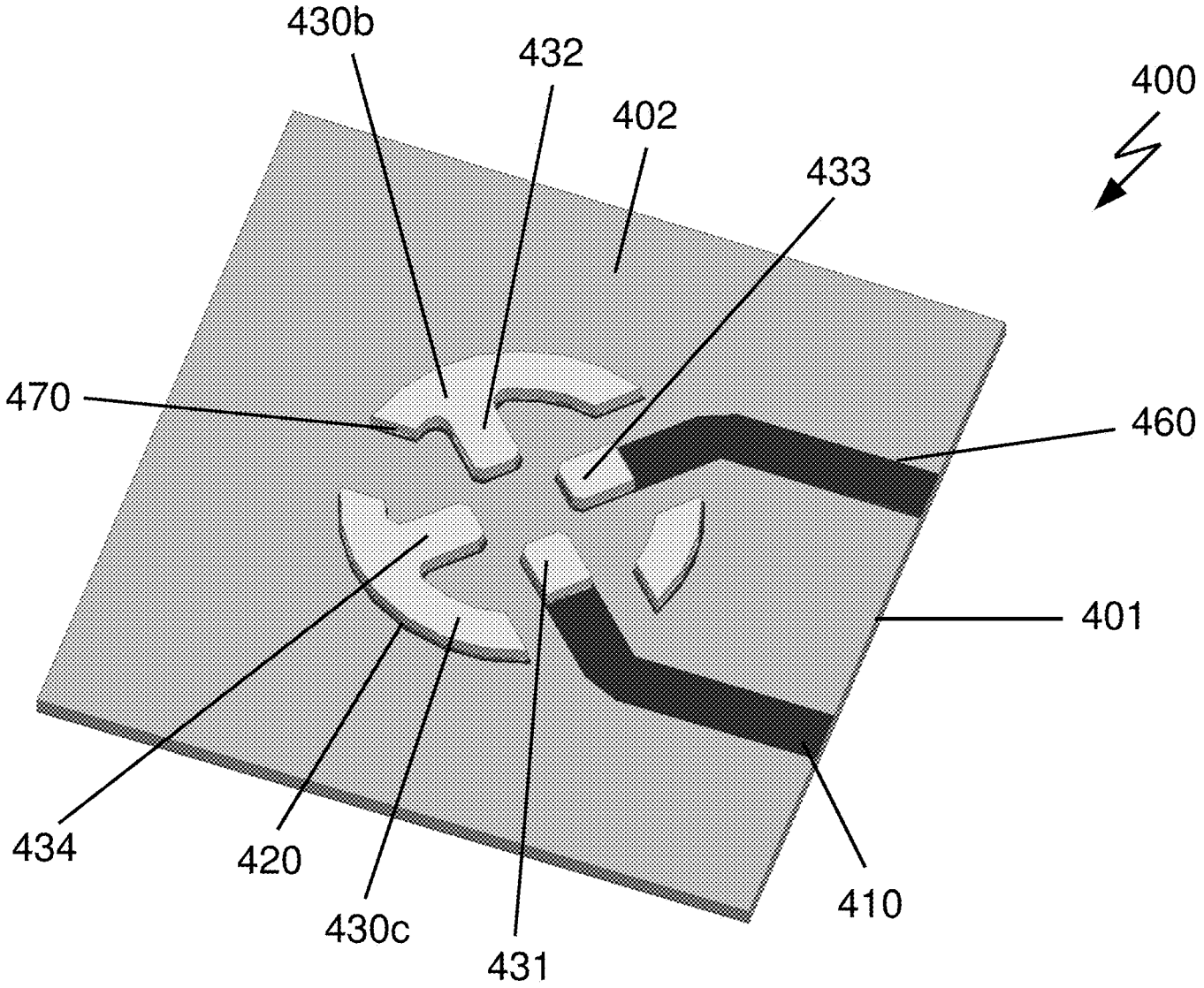
FIG. 4*b*: the antenna element of FIG. 4*a*, cut along a first plane extending parallel to the circuit board.
Figure 4C:
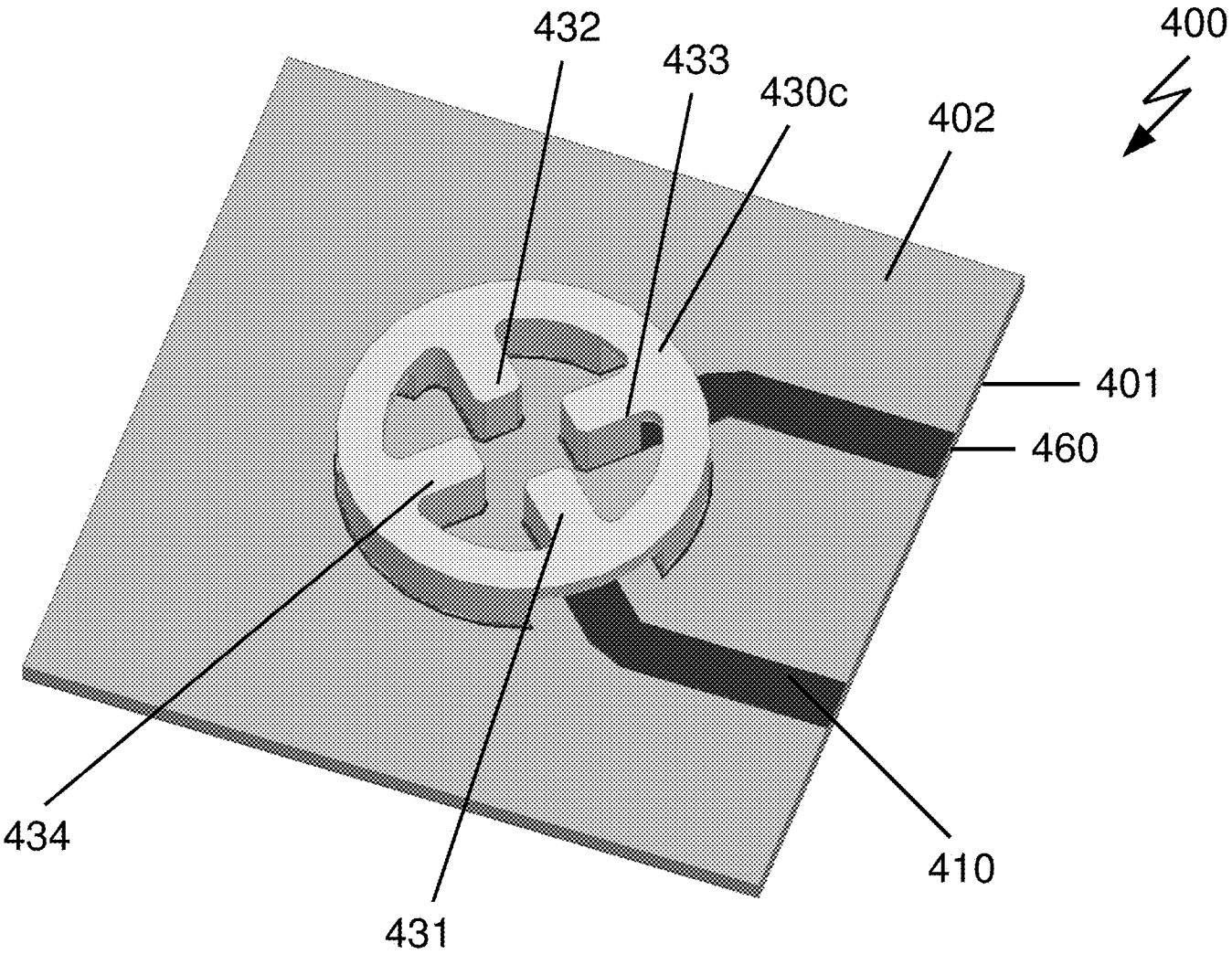
FIG. 4*c*: the antenna element of FIG. 4*a*, cut along a second plane extending parallel to the circuit board and located above the first plane.

The embodiment of FIG. 4*a-c*, shows an antenna element 400 with two feed-lines 410, 460. Depending on what kind of signals are fed to these two feed lines 410, 460, a dual polarized signal can be sent over the antenna, whereby the two signals can be different or equal. In the representation of FIG. 4*b*, the upper part and an intermediate part of the ring-shaped structure 430 have been removed in order to allow for improved understanding of the embodiment. In the representation of FIG. 4*c*, only the upper part of the ring-shaped structure 430 has been removed.

Due to the dual-polarized application with two feed-lines, the circuit board 401 has not only a first conductor 410 and a second conductor 420, but also a third conductor 460 and a fourth conductor 470. The second conductor 420 and the fourth conductor 470 extend through the circuit board 401 to the rear side of the circuit board 401 which is not visible in FIG. 4*a,b*. It can either continue on said rear side of the circuit board 101, but second conductor 420 and fourth conductor 470 may also both merge with a joint ground plane extending over at least part of the rear surface of the circuit board 401.

On top of the circuit board 401 a separate, 3-dimensional, metallic or metallized ring-shaped structure 430 with an essentially circular geometry and four ridges 431, 432, 433, 434 extending radially towards the center of said circular geometry arranged in two pairs of opposing ridges 431, 432 and 433, 434, respectively, is located on surface 402 of the circuit board 401. It should be noted that the first pair of opposing ridges 431, 432 is oriented orthogonally to the second pair of opposing ridges 433,434 in a plane parallel to the surface 402 of the circuit board 401.

The lower part of said ring-structure 430, i.e. the part that is adjacent to the circuit board and on which the galvanic contacts between conductors 410, 420, 460, 470 and ring-shaped structure 430 are created is shown in FIG. 4*b*. Concentrically arranged on top of this lower part is an essentially donut-shaped higher part 430*a* with a larger inner diameter and a larger outer diameter, so that at least sections of the inner walls of the ring-shaped structure 430 are stepped.

As can be seen in FIG. 4*b*, there are gaps 411 between the first conductor 410 and the second conductor 420 and 412 between the third conductor 460 and the fourth conductor 470. As seen in FIG. 4*a* and FIG. 4*c*, the gaps 411, 412 are bridged by the donut-shaped part 430*a* of the ring-shaped structure 430.

Returning to FIG. 4*b*, ridges 432 and 434 extend from sections 430*b*, 430*c* that correspond to sections of a circular ring. Accordingly, the galvanic contacts formed e.g. by soldering between the second conductor 420 and section 430*b* and between the fourth conductor 470 and section 430*c* each comprise an L-shaped section as defined above.

As best seen in FIG. 4*c*, ridges 431, 432, 433 and 433 are connected to an intermediate circular ring structure 430*d* of the ring-shaped structure 430.

Figure 6:
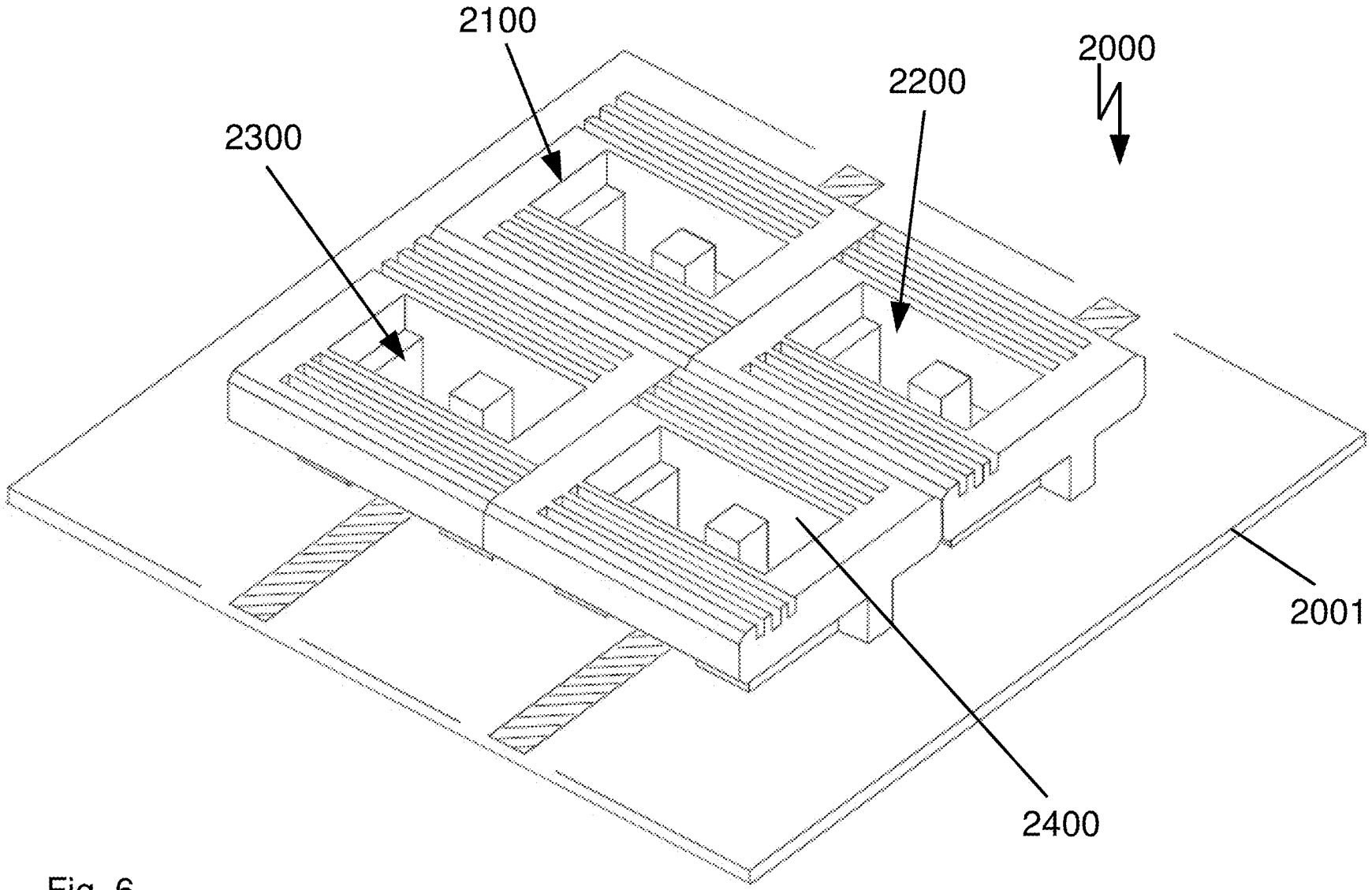
FIG. 6: a second embodiment of an antenna array.

As shown in FIGS. 5 and 6, antenna arrays 1000, 2000 can be formed, e.g. by arrangement of antenna elements 1100, 1200, 1300 in a row on a common circuit board 1001 or of antenna elements 2100, 2200, 2300, 2400 in a 2×2 array on a common circuit board 2001. In this example, the antenna elements 1100, 1200, 1300 and 2100, 2200, 2300, 2400, respectively, each correspond to the antenna element 200 described above in the context of FIG. 2*a,b*.

REFERENCE NUMERALS

100, 200, 300, 400, 1100, 1200, 1300, 2100, 2200, 2300, 2400 antenna element

101, 201, 301, 401, 1001, 2001 circuit board

102, 202, 302, 402 surface

110, 120, 210, 220, 310, 320, 410, 420, 460, 470 conductor
130, 230, 330, 430 ring-shaped structure
111, 112, 211, 212, 311, 312, 411, 412 gap
131, 132, 232, 431, 432, 433, 434 ridge
221 connecting section
236, 238, 336 pin
237, 239, 240, 241 sidewall
237*a*, 237*b*, 240*a*, 241*a* section of sidewall
250, 260 galvanic contact
390 focusing element
430*a*, 430*b*, 430*c*, 430*d* part of ring-shaped structure
t thickness

Summary

The invention provides an antenna element (100, 200, 300, 400) comprising a circuit board (101, 201, 301, 401) with a transmission line, said transmission line comprising at least a first conductor (110, 210, 310, 410) and a second conductor (120, 220, 320, 420),
a separate 3-dimensional, metallic or metallized ring-shaped structure (130, 230, 330, 430) mounted on a surface (102, 202, 302, 402) of said circuit board (101, 201, 301, 401), a first galvanic contact between said first conductor (110, 210, 310, 410) and a first part of said separate 3-dimensional, metallic ring-shaped structure (130, 230, 330, 430), and a second galvanic contact between said second conductor (120, 220, 320, 420) and a second part of said separate 3-dimensional, metallic ring-shaped structure (130, 230, 330, 430), wherein at least one of said first galvanic contact and said second galvanic contact comprises at least two essentially L-shaped sections and an antenna array (1000, 2000) comprising several such antenna elements (100, 200, 300, 400).

The invention claimed is:

1. An antenna element, comprising:
- a circuit board with a planar transmission line, the planar transmission line comprising a first conductor and a second conductor;
- a 3-dimensional metallic ring-shaped structure mounted on a surface of the circuit board;
- a first galvanic contact between the first conductor and a first part of the 3-dimensional metallic ring-shaped structure;
- a second galvanic contact between the second conductor and a second part of the 3-dimensional metallic ring-shaped structure;
- wherein the first galvanic contact and the second galvanic contact respectively comprise at least two substantially L-shaped sections;
- wherein sections of sidewalls of the 3-dimensional metallic ring-shaped structure that define an opening of the 3-dimensional metallic ring-shaped structure are tapered or stepped; and
- wherein the antenna element is designed for a wavelength $\lambda$ of a millimeter-wave frequency band of operation, and a height of the 3-dimensional metallic ring-shaped structure is $>\lambda/3$.

2. The antenna element according to claim 1, wherein the first galvanic contact and the second galvanic contact are arranged on opposite sides of the 3-dimensional metallic ring-shaped structure.

3. The antenna element according to claim 1, wherein the 3-dimensional metallic ring-shaped structure is shaped in such a way that it bridges a gap between the first conductor and the second conductor.

4. The antenna element according to claim 1, wherein the 3-dimensional metallic ring-shaped structure is shaped in such a way that it comprises an opening for optical inspection of at least one of the first and second galvanic contacts.

5. The antenna element according to claim 1, wherein the 3-dimensional metallic ring-shaped structure comprises a pair of ridges with equal or different protrusion depths that are located opposite to each other on opposing sides of the 3-dimensional metallic ring-shaped structure.

6. The antenna element according to claim 1, wherein the 3-dimensional metallic ring-shaped structure comprises or is connected to pins.

7. The antenna element according to claim 1, wherein other sections of the sidewalls that define a radiating aperture of the antenna element have a higher thickness (t) than remaining parts of the 3-dimensional metallic ring-shaped structure.

8. The antenna element according to claim 7, wherein the other sections of the sidewalls that define the radiating aperture have a corrugated surface.

9. The antenna element according claim 8, wherein a dielectric focusing element is located on top of the radiating aperture.

10. The antenna element according to claim 1, wherein the planar transmission line is a microstrip transmission line or a co-planar waveguide transmission line.

11. An antenna array formed by several of the antenna element according to claim 1.

12. A device, comprising:
- a circuit board with a transmission line having a first conductor and a second conductor;
- a 3-dimensional metal ring structure mounted on a surface of the circuit hoard, wherein the 3-dimensional metal ring structure comprises a pair of ridges that are located opposite to each other on opposing sides of the 3-dimensional metal ring structure, and wherein the 3-dimensional metal ring structure comprises sidewalls, wherein at least one sidewall of the sidewalk; is tapered, and wherein at least one sidewall of the sidewalls comprises a radiating aperture with an increased sidewall thickness and a corrugated surface;
- a first galvanic contact between the first conductor and a first part of the 3-dimensional metal ring structure;
- a second galvanic contact between the second conductor and a second part of the 3-dimensional metal ring structure;
- wherein the first galvanic contact, the second galvanic contact, or both the first galvanic contact and the second galvanic contact comprise at least two substantially L-shaped sections;
- wherein the first galvanic contact and the second galvanic contact are arranged on opposite sides of the 3-dimensional metal ring structure;
- wherein the 3-dimensional metal ring structure bridges a gap between the first conductor and the second conductor; and
- wherein the 3-dimensional metal ring structure comprises an opening for optical inspection of at least one of the first and second galvanic contacts.

* * * * *